US008127927B2

(12) United States Patent
Simottel et al.

(10) Patent No.: US 8,127,927 B2
(45) Date of Patent: Mar. 6, 2012

(54) ERECTABLE PACKAGING, PARTICULARLY FOR A BOTTLE

(75) Inventors: Benoît Simottel, Boujacourt (FR); Anne-Sophie Franquet, Reims (FR); Roberto Marini, Limoges (FR)

(73) Assignee: MHCS, Epernay (FR)

( * ) Notice: Subject to any disclaimer, the term of this patent is extended or adjusted under 35 U.S.C. 154(b) by 171 days.

(21) Appl. No.: 12/295,329

(22) PCT Filed: Mar. 23, 2007

(86) PCT No.: PCT/FR2007/000504

§ 371 (c)(1),
(2), (4) Date: Sep. 30, 2008

(87) PCT Pub. No.: WO2007/118961

PCT Pub. Date: Oct. 25, 2007

(65) Prior Publication Data

US 2009/0071856 A1 Mar. 19, 2009

(30) Foreign Application Priority Data

Mar. 30, 2006 (FR) ..... 06 02772

(51) Int. Cl.
*B65D 5/50* (2006.01)

(52) U.S. Cl. ..... 206/446; 229/89; 229/186; 229/101

(58) Field of Classification Search ..... 206/736, 206/737, 139, 162, 167, 427, 446; 229/89, 229/91, 123, 186, 117.24, 187–188, 101, 229/117.16

See application file for complete search history.

(56) References Cited

U.S. PATENT DOCUMENTS

| | | | | |
|---|---|---|---|---|
| 3,900,157 | A | 8/1975 | Roth | |
| 6,050,483 | A * | 4/2000 | Haraldsson et al. | 229/114 |
| 6,253,993 | B1 * | 7/2001 | Lloyd et al. | 229/117.3 |
| 6,523,738 | B1 | 2/2003 | Sarne et al. | |
| 6,736,309 | B1 * | 5/2004 | Westerman et al. | 229/117.05 |
| 6,837,420 | B2 * | 1/2005 | Westerman et al. | 229/117.15 |
| 7,097,034 | B2 * | 8/2006 | Woog | 206/427 |
| 2003/0234201 | A1 * | 12/2003 | Shah et al. | 206/521 |
| 2009/0084706 | A1 * | 4/2009 | Keefe, Jr. | 206/736 |

FOREIGN PATENT DOCUMENTS

| | | | |
|---|---|---|---|
| DE | 90 06 587 | U1 | 8/1990 |
| FR | 2 848 186 | A | 6/2004 |
| GB | 1 163 521 | A | 9/1969 |
| NL | 7 308 096 | A | 12/1974 |
| WO | 02/14165 | A1 | 2/2002 |

* cited by examiner

*Primary Examiner* — J. Gregory Pickett
*Assistant Examiner* — Robert Poon
(74) *Attorney, Agent, or Firm* — Young & Thompson

(57) ABSTRACT

Erectable packaging including a bottom, first and second parallel lateral walls (3, 4), and third and fourth mutually opposite lateral walls (5, 6), with the third and fourth lateral walls able to be displaced between a storage position and an erected position. The bottom and the lateral walls are made from a cruciform blank, the lateral walls including two flaps (16-19) articulated on each lateral wall. The flaps are all folded parallel to the first and second lateral walls and include slits (21) and lugs (23) that engage by being fitted together so as to limit the displacement of the third and fourth lateral walls. The bottom and the lateral walls are connected to each other in a leak proof way by a flexible membrane (20).

8 Claims, 12 Drawing Sheets

ERECTABLE PACKAGING, PARTICULARLY FOR A BOTTLE

FIELD OF THE INVENTION

The present invention relates to erectable packaging, particularly for bottles.

More specifically, the invention relates to erectable packaging comprising a blank that forms at least one base and four lateral walls each extending between two lateral edges from a lower extremity secured to the base to a free upper extremity, said lateral walls comprising parallel, mutually opposite first and second lateral walls and parallel, mutually opposite third and fourth lateral walls, the third and fourth lateral walls being connected to the first and second lateral walls to enable each of said third and fourth walls to move between a storage position in which the upper extremities of said third and fourth lateral walls are relatively close to each other and an erected position in which the upper extremities of said third and fourth lateral walls are further away from each other.

BACKGROUND OF THE INVENTION

Document FR-A-2 786 752 describes an example of such erectable packaging, which has the drawback of being relatively costly.

SUMMARY OF THE INVENTION

A particular subject of the present invention is to overcome these drawbacks.

To this end, according to the invention, packaging of the type in question is characterised in that the blank is cruciform and comprises first, second, third and fourth arms that respectively include the first, second, third and fourth lateral walls, each of said arms also including at least two flaps articulated on the corresponding lateral wall, in that the flaps on the first, second, third and fourth lateral walls are all parallel to the first and second lateral walls and respectively comprise slits and lugs that cooperate by being fitted together to limit the displacement of the third and fourth lateral walls, and in that the base and the lateral walls are connected to each other by at least a first flexible membrane enabling the packaging to contain a liquid in a leak proof manner.

By virtue of these arrangements, one cardboard or similar blank is sufficient to form the packaging, compared with two blanks in the aforementioned known packaging, which reduces the cost price of said packaging. Furthermore, excellent leak proofing of the packaging is ensured vis-à-vis the water that can be poured into it, particularly due to the presence of the aforementioned flexible membrane.

In various embodiments of the method according to the invention, one or more of the following arrangements may be used:

- the flaps on the first and second lateral walls each comprise a lug and the flaps on each of the third and fourth walls each comprise a slit receiving one of said lugs;
- the slits in the flaps on the third lateral wall are arc-shaped and centred on the lower extremity of said third lateral wall, whilst the slits in the flaps on the fourth lateral wall are arc-shaped and centred on the lower extremity of said fourth lateral wall;
- the flaps on the third and fourth lateral walls also comprise cut-outs that are not parallel to said slits and open into said slits;

- the flaps on the third and fourth lateral walls are articulated respectively on the lateral edges of the third and fourth lateral walls;
- the flaps on the first and second lateral walls each comprise a first section articulated on one of the lateral edges of the corresponding lateral wall and a second section folded downwards and articulated on the upper edge of the first section, said second section being extended by one of said lugs that enters one of the slits in the flaps on the third and fourth lateral walls;
- the lugs on the second sections of the first lateral wall extend downwards from the second sections and are rigidly attached to the first sections of said first lateral wall, and the lugs on the second sections of the second lateral wall extend downwards from the second sections and are rigidly attached to the first sections of said second lateral wall;
- the flaps on the first and second lateral walls each comprise a first section articulated on one of the lateral edges of the corresponding lateral wall and a second section folded downwards and articulated on the upper edge of the first section, said first section comprising a cut-out lug that enters one of the slits in the flaps on the third and fourth lateral walls;
- the lugs on the first sections of the first lateral wall extend upwards from said first sections and are rigidly attached to the second sections of said first lateral wall, and the lugs on the first sections of the second lateral wall extend upwards from said first sections and are rigidly attached to the second sections of said second lateral wall;
- the first sections of the first lateral wall are rigidly attached to the inner surface of said first lateral wall, and the first sections of the second lateral wall are rigidly attached to the inner surface of said second lateral wall;
- the first sections of the first lateral wall overlap at least partly and are rigidly attached to each other, and the first sections of the second lateral wall overlap at least partly and are rigidly attached to each other; the second sections of the first lateral wall overlap at least partly and are rigidly attached to each other, and the second sections of the second lateral wall overlap at least partly and are rigidly attached to each other;
- the second sections of the first and second lateral walls at least partly overlap the corresponding flaps on the third and fourth lateral walls;
- the blank is made from cardboard;
- the first membrane is attached to the inner surfaces of the base, the lateral walls and the flaps;
- the first membrane is made from a synthetic material, in particular polypropylene;
- the packaging comprises a second membrane that is attached to the outer surfaces of the base, the lateral walls and the flaps, and to the outer surface of the first membrane between the four arms of the blank;
- the second membrane is made from a synthetic material, in particular polypropylene;
- the first and second lateral walls each comprise, toward their upper extremity, an opening defining a handle;
- a detachable lid is attached at least to the upper extremities of the third and fourth lateral walls.

BRIEF DESCRIPTION OF THE DRAWINGS

Further characteristics and advantages of the invention will become apparent on reading the following description of two of its embodiments, given as non-limitative examples, in relation to the attached drawings.

In the drawings.

In the various Figures, the same references denote identical or similar components.

MORE DETAILED DESCRIPTION

The erectable packaging shown in FIGS. 1 to 6 comprises a blank made from cardboard, plastic or another material that forms, in a single piece, a base 2 and four lateral surfaces 3, 4, 5, 6. Each of the lateral surfaces 3-6 extends between two lateral edges, from a lower extremity articulated on the base 2 to a free upper extremity.

These four lateral walls comprise:

- parallel first and second lateral walls, 3, 4, opposite each other,
- and mutually opposite third and fourth lateral walls 5, 6 which are movably connected to the first and second lateral walls 3, 4.

Figure 1:
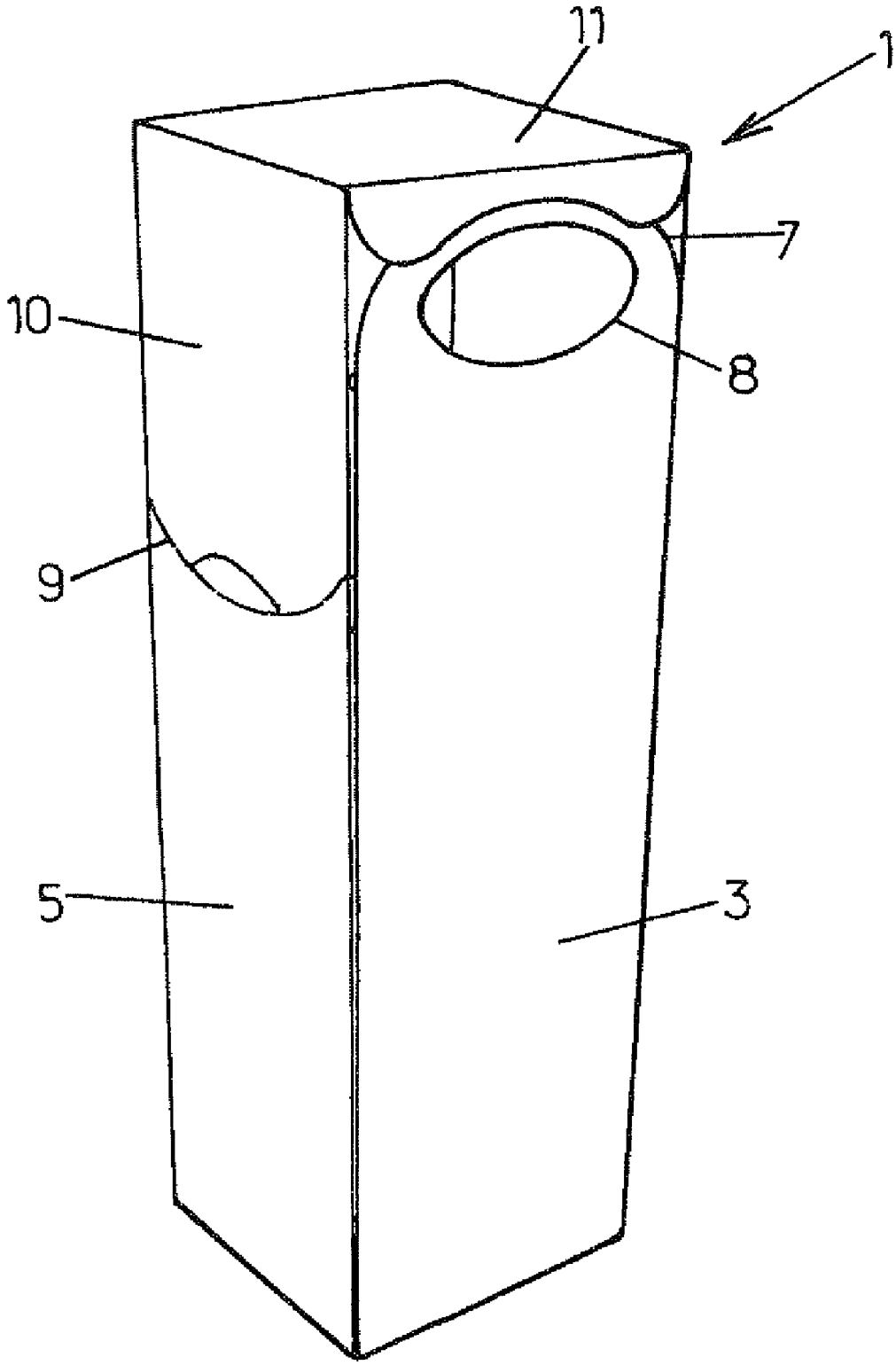
FIG. 1 is a perspective view of erectable packaging according to a first embodiment of the invention, in a storage position.
Figure 2:
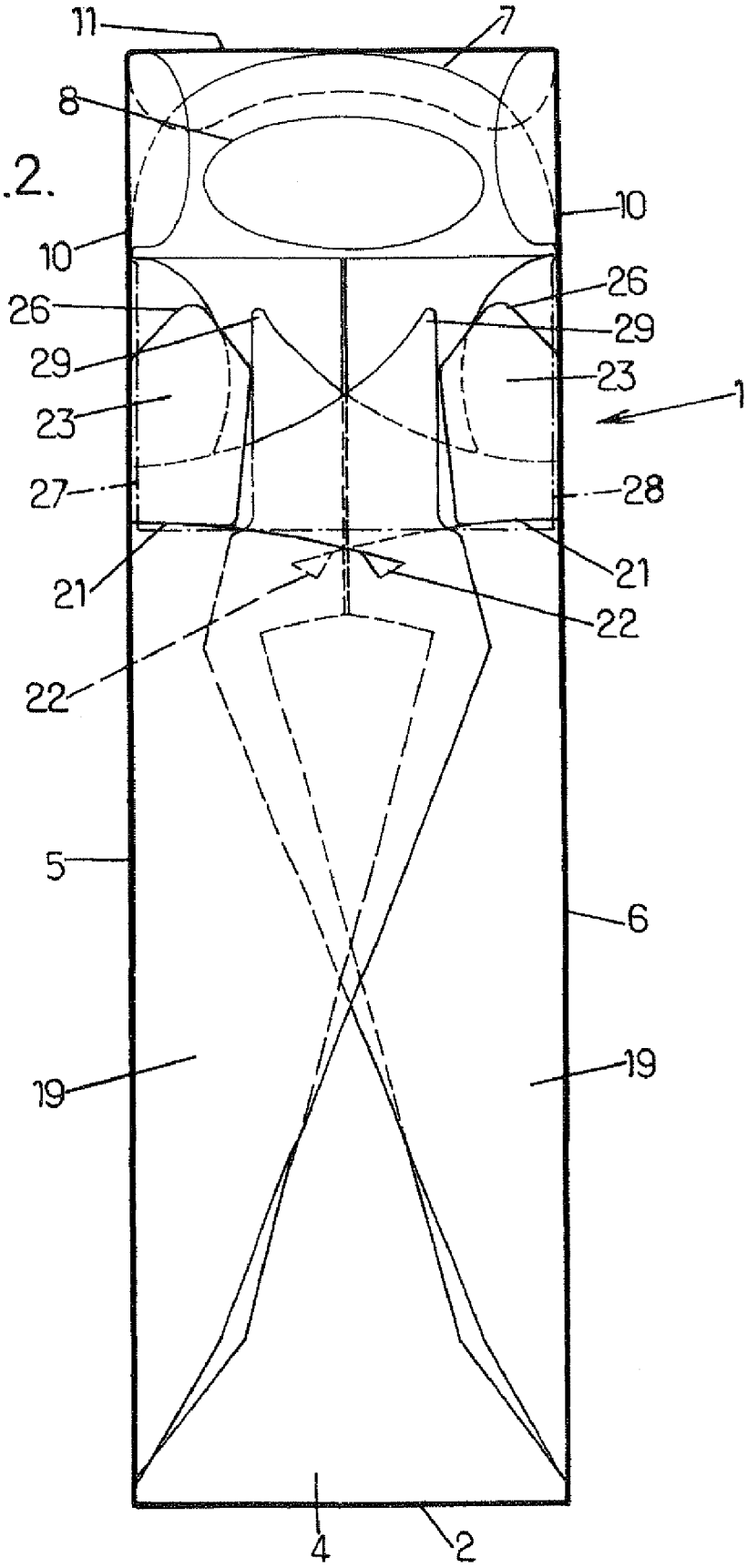
FIG. 2 is a vertical cross-sectional view of the packaging in FIG. 1, the second sections of the second lateral wall having been removed for greater clarity.
Figure 3:
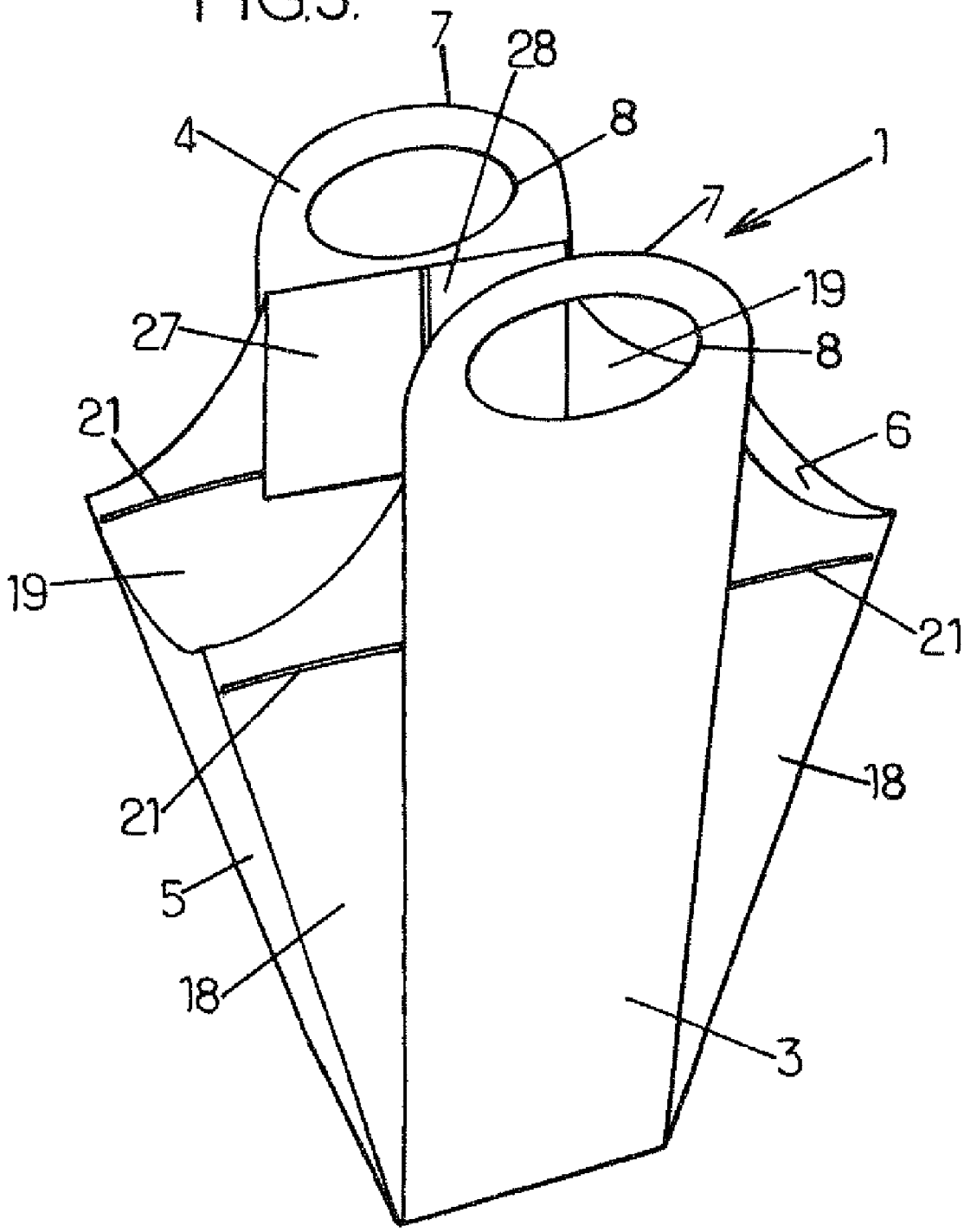
FIGS. 3 and 4 are similar views to FIGS. 1 and 2, showing the packaging in an erected position.
Figure 4:
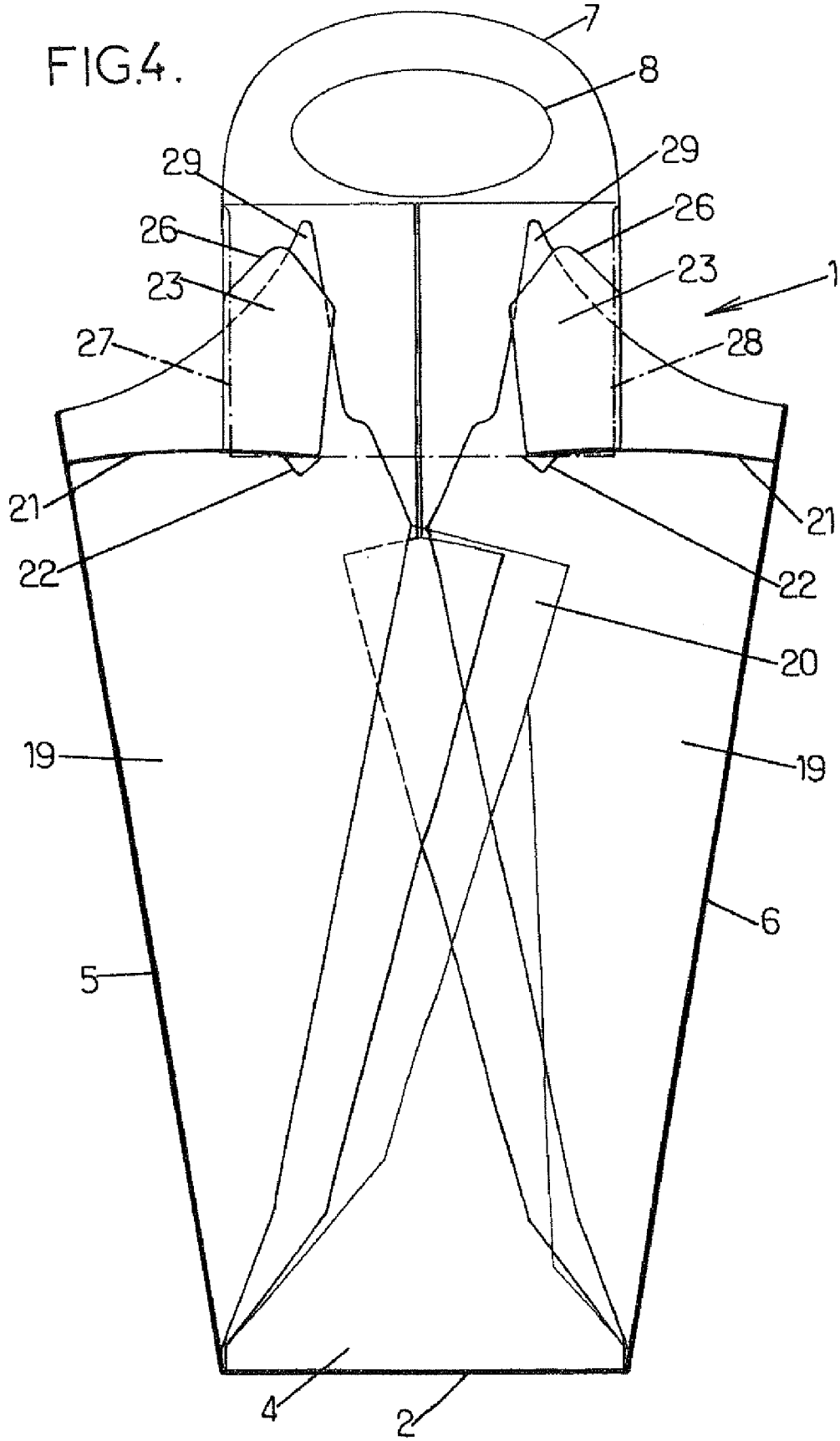

The third and fourth lateral walls 5, 6 are connected to the first and second lateral walls 3, 4 in such a way as to allow each of said third and fourth lateral walls 5, 6 to be moved between:

- the storage position shown in FIGS. 1 and 2, in which the upper extremities of the third and fourth lateral walls 5, 6 are relatively close to each other (in this position, the third and fourth lateral walls are approximately parallel with each other),
- and the erected position shown in FIGS. 3 and 4, in which the upper extremities of said third and fourth lateral walls 5, 6 are further apart from each other, said third and fourth lateral walls thus forming between them an angle of between 15 and 30°, for example.

The packaging 1 is designed to contain for example a bottle, particularly a bottle of Champagne, and it can be used as a Champagne bucket in the aforementioned erected position. In this erected position, ice and/or water can therefore be added inside the packaging 1 to cool down the bottle that it contains.

As can be seen in particular in FIGS. 1 and 3, the upper extremity of each of the first and second lateral walls 3, 4 can be defined at the top by a convex rounded upper edge 7 below which an opening 8 is arranged, which can be for example a horizontally elongated oval shape, in such a way as to form two handles in the upper part of the packaging 1, thus facilitating the transport of said packaging by a user.

Figure 5:
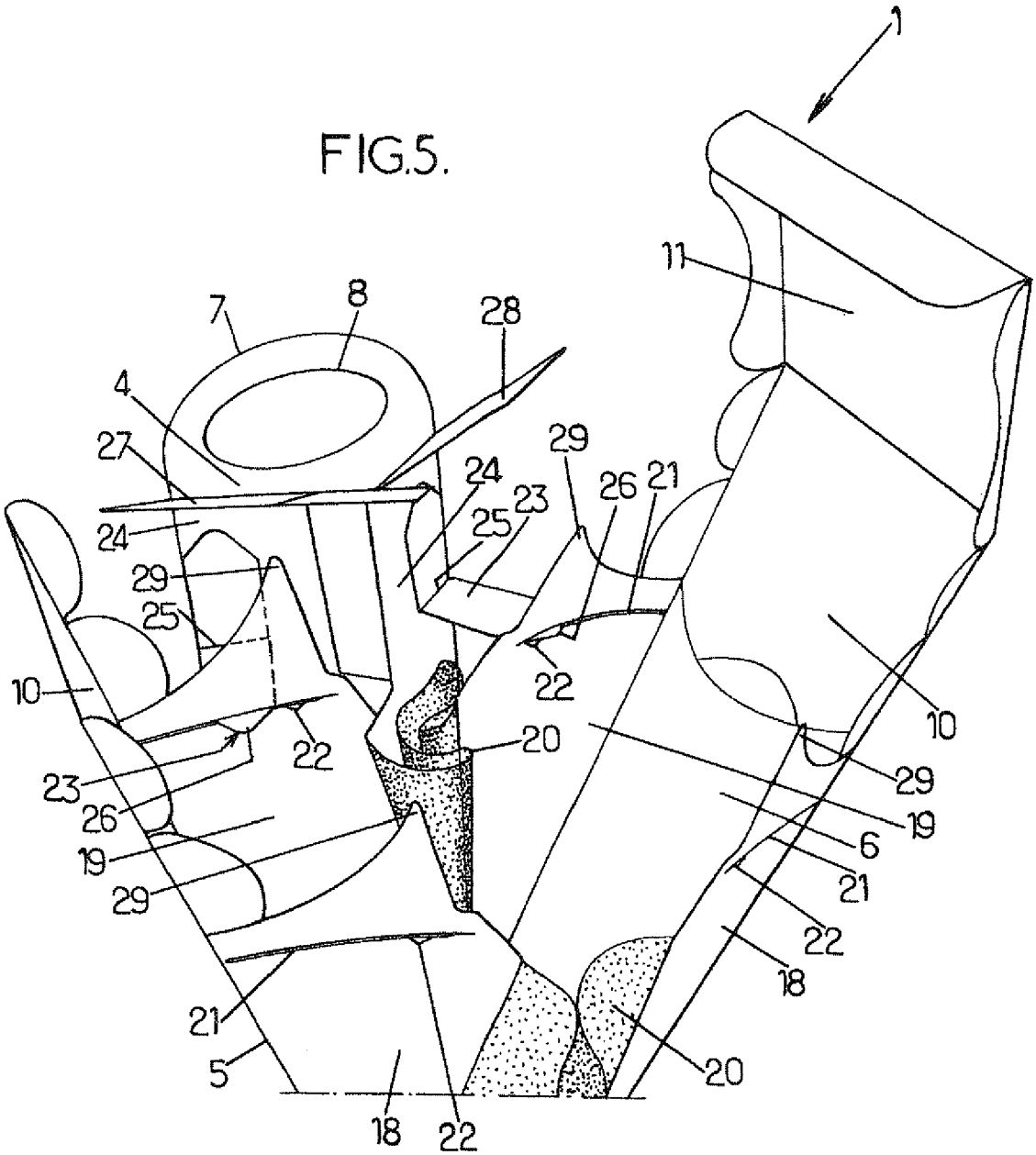
FIG. 5 is a partial perspective view showing the packaging during assembly.
Figure 6:
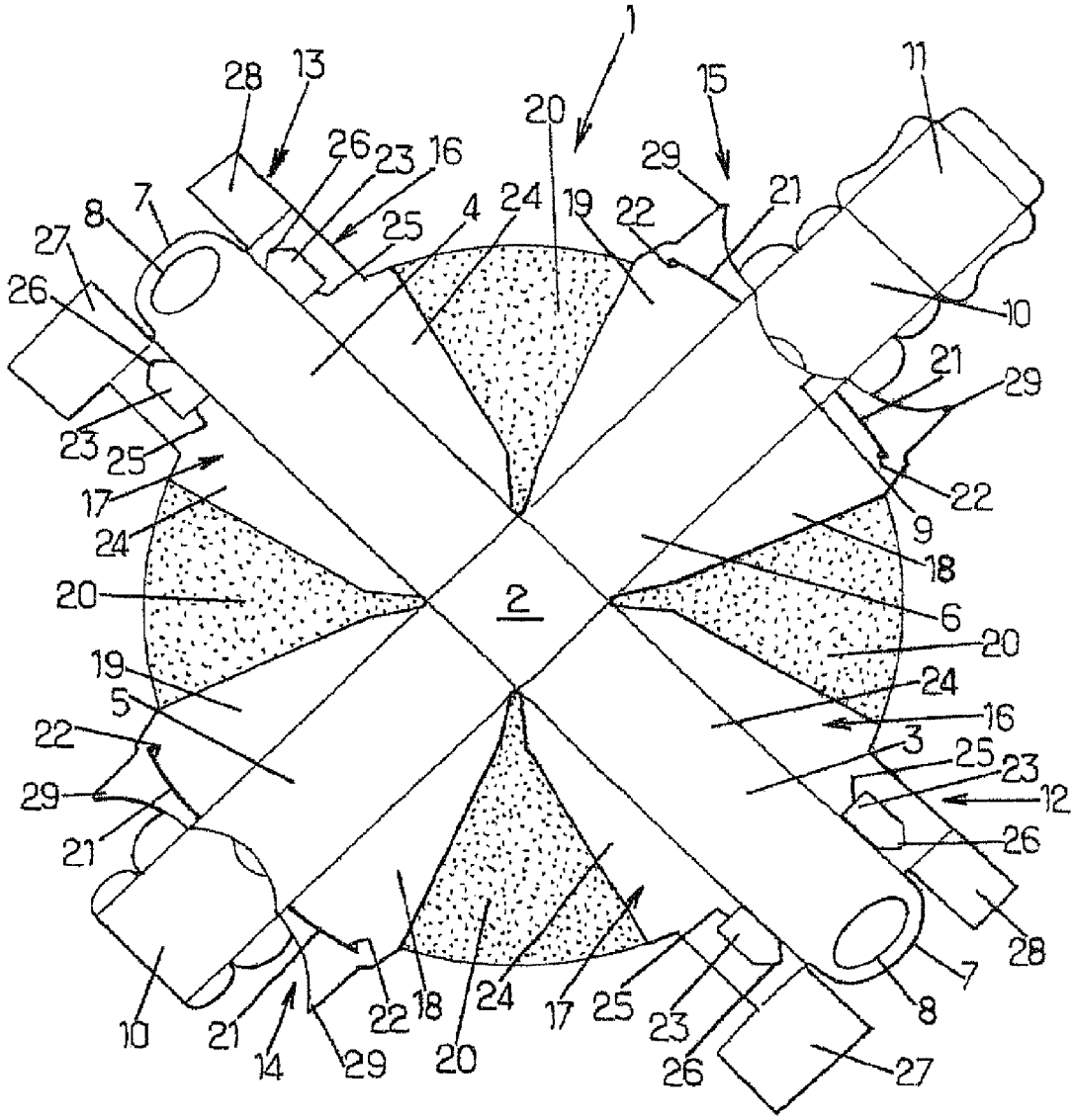
FIG. 6 is a flat view of the packaging in FIGS. 1 to 5, fully unfolded.

Furthermore, as can be seen in particular in FIGS. 1, 5 and 6, the third and fourth lateral walls 5, 6 can each have a pre-cut area 9 that allows for the upper extremity 10 of said third and fourth lateral walls to be detached. The upper extremity 10 of the fourth lateral wall 6 is also extended by an upper wall 11 that is glued to the upper extremity 10 of the third lateral wall. The upper extremities 10 of the third and fourth lateral walls 5, 6, together with the upper wall 11, form a detachable lid.

As shown in FIGS. 5 and 6, the blank made from cardboard, plastic or a similar material, is cruciform and comprises first, second, third and fourth arms 12, 13, 14 and 15 which include respectively the first, second, third and fourth lateral walls 3, 4, 5, 6 and which each also include two articulated flaps, 16, 17 for the first and second lateral walls 3, 4 and 18, 19 for the third and fourth lateral walls 5, 6 respectively.

The flaps 16, 17, 18, 19 are respectively articulated along the lateral edges of the corresponding lateral walls and, when the packaging 1 is assembled, all of these flaps are arranged parallel to the first and second lateral walls 3, 4.

As will be explained below, the flaps 16, 17, 18, 19 respectively comprise slits and lugs that cooperate by fitting into each other to limit the displacement of the third and fourth lateral walls 5, 6 in the erected position.

Furthermore, as can be seen in FIG. 6, a flexible membrane 20, for example a thin film of polypropylene, is glued to the inner surface of the cardboard blank and forms a continuation between the various arms 12, 13, 14, 15 of the blank. Advantageously, two identical or similar flexible membranes 20 are glued respectively to the inner surface and the outer surface of the cardboard blank, and are glued to each other between the various arms 12-15 of the cardboard blank.

When the packaging 1 is assembled from the cardboard blank shown in FIG. 6, the portions of the membranes 20 that are located between the various arms 12-15 of the cardboard blank fold like bellows (see FIG. 5) and render the packaging 1 leak proof vis-à-vis the water or other liquid that can be poured into it.

In the example in FIGS. 1 to 6, the flaps 18, 19 on the third and fourth lateral walls 5, 6 each comprise an arc-shaped slit 21. The slits 21 in the flaps 18 located on the side of the first lateral wall 3 are centred on the lower edge of said first lateral wall 3, and the slits 21 in the flaps 19 located on the side of the second lateral wall 4 are centred on the lower edge of said second lateral wall 4.

Furthermore, the flaps 18, 19 each comprise a cut-out 22 that is not parallel to the corresponding slit 21 and opens into said cut-out. In the example in question, the cut-out 22 is triangular and is located at the extremity of the slit 21 furthest away from the corresponding lateral wall 5, 6. These cut-outs 22 facilitate the insertion of the lugs 23 on the flaps 16, 17 into the slits 21, as will be explained below.

The flaps 16, 17 in question each comprise, in the example under consideration, a first section 24 articulated on one of the lateral edges of the corresponding lateral wall 3, 4, each of the lugs 23 being cut out in one of said first sections 24 and extending upwards from a lower extremity 25 articulated on the first section 24 to a free upper extremity 26, which here is pointed.

Each first section 24 is also extended upwards, on its upper extremity, by a second section 27, 28 respectively, which is articulated on the upper edge of said first section 24.

When the packaging 1 is assembled, as shown in FIG. 5, the lateral walls 3-6 are folded toward each other, the flaps 18, 19 on the third and fourth lateral walls are folded at 90° relative to said third and fourth lateral walls 5, 6, and the first sections 24 on the flaps 16, 17 are folded at 180° against the inner surface of the first and second lateral walls 3, 4.

Said first sections 24 can advantageously at least partly overlap and be rigidly attached to each other for example by gluing, whilst also being rigidly attached, for example by gluing, to the inner surface of the first and second lateral walls 3, 4.

The first sections 24 could optionally only be attached by gluing to the inner surface of the first and second lateral walls 3, 4, or only be rigidly attached to each other and not to said inner surface of the first and second lateral walls 3, 4.

When the packaging is assembled, the aforementioned lugs 23 are also slid inside the slits 21 on the flaps 18, 19 (see FIG. 5), then said lugs 23 are raised parallel to the first and second lateral walls 3, 4 and the second sections 27, 28 are folded at 180° downwards and are preferably rigidly attached, in particular by gluing, to said lugs 23 (see in particular FIGS. 2, 3, 4). Advantageously, the second section 27 is wider than the second section 28, so that said second section 28 at least partly covers the second section 27 and is rigidly attached to it, for example by gluing.

It will be noted that the upper extremities 29 of the flaps 18, 19, which are pointed in the example shown in the drawings, are covered by the second sections 27, 28, which contributes to excellent guidance of the flaps 18, 19 during erection.

The erectable packaging 101 according to the second embodiment of the invention, shown in FIGS. 7 to 12, comprises a blank made from cardboard, plastic or another material that forms, in a single piece, a base 102 and four lateral surfaces 103, 104, 105, 106. Each of the lateral surfaces 3-6 extends between two lateral edges, from a lower extremity articulated on the base 102 to a free upper extremity.

These four lateral walls comprise:

- parallel first and second lateral walls 103, 104, opposite each other,
- and mutually opposite third and fourth lateral walls 105, 106 which are movably connected to the first and second lateral walls 103, 104.

Figure 7:
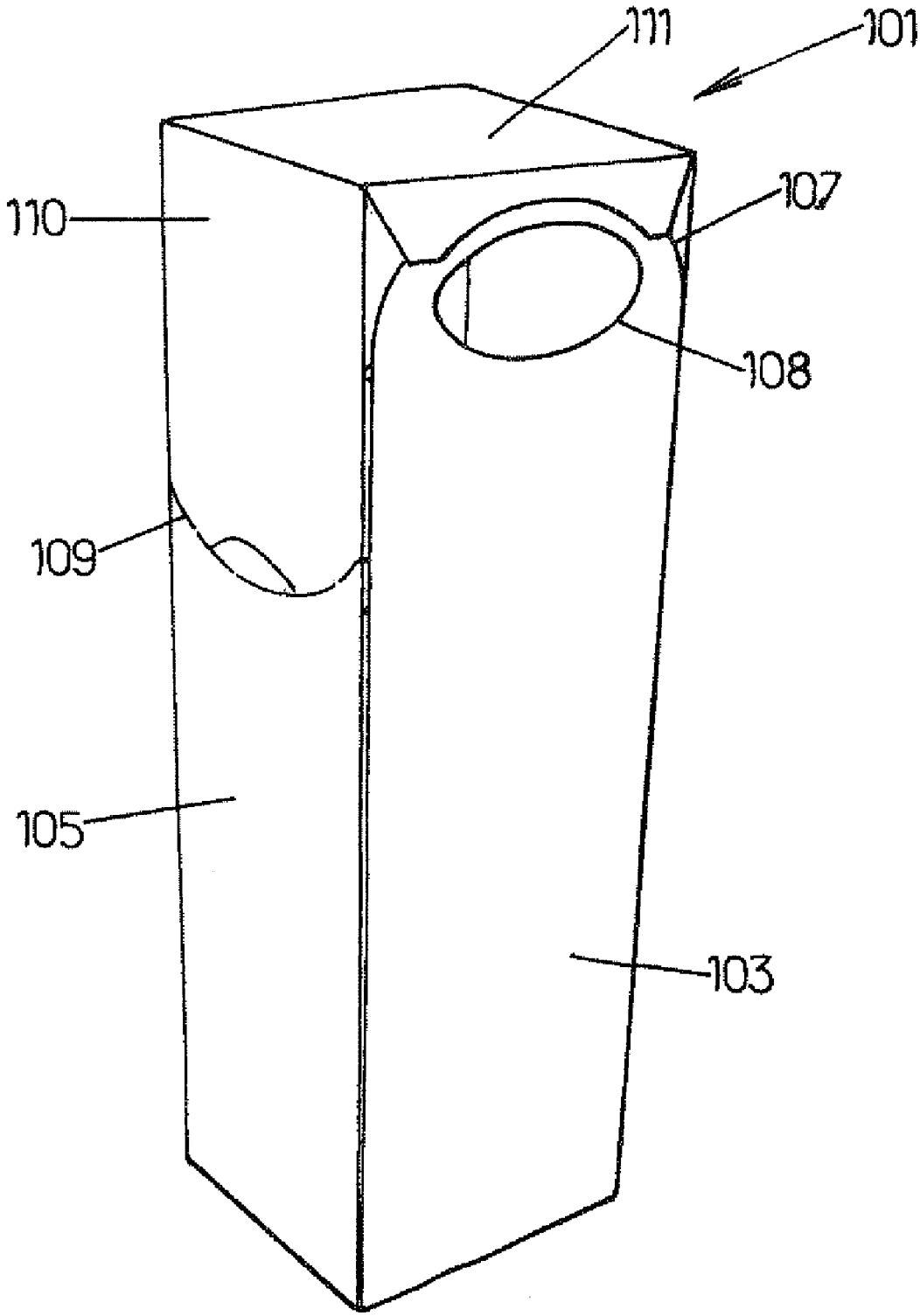
FIGS. 7 to 12 are similar views to FIGS. 1 to 6 respectively, for a second embodiment of the invention.
Figure 8:
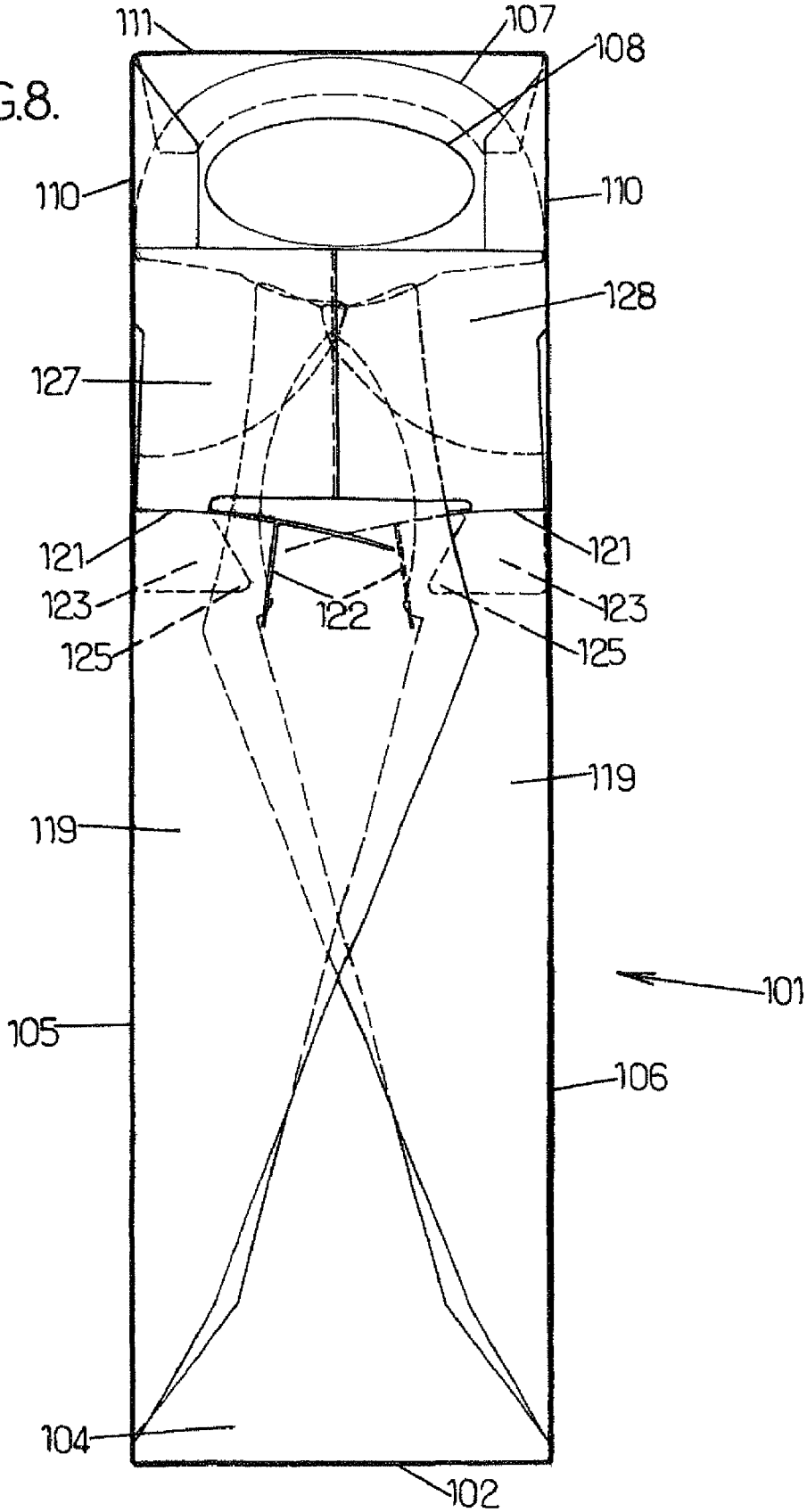
Figure 9:
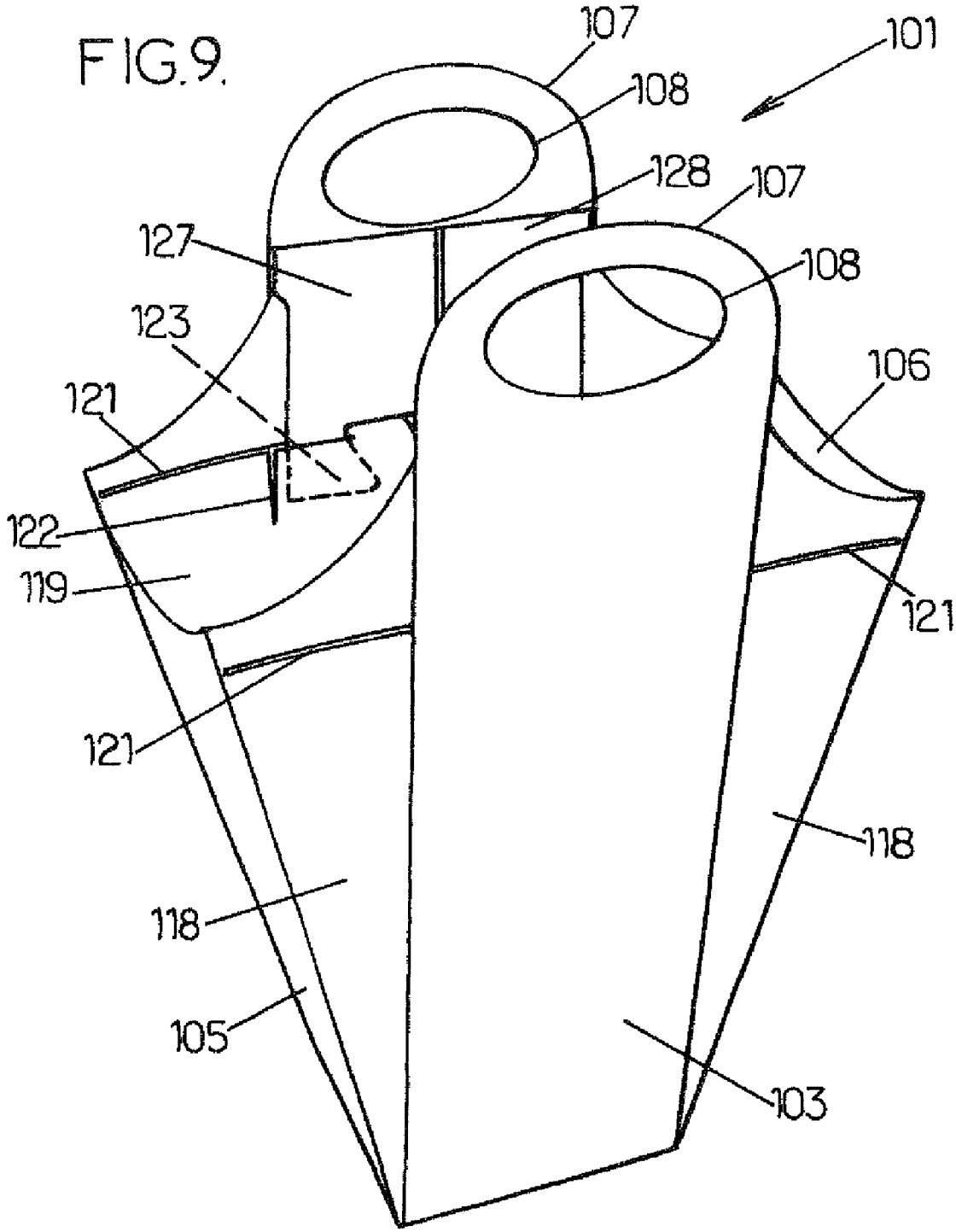
Figure 10:
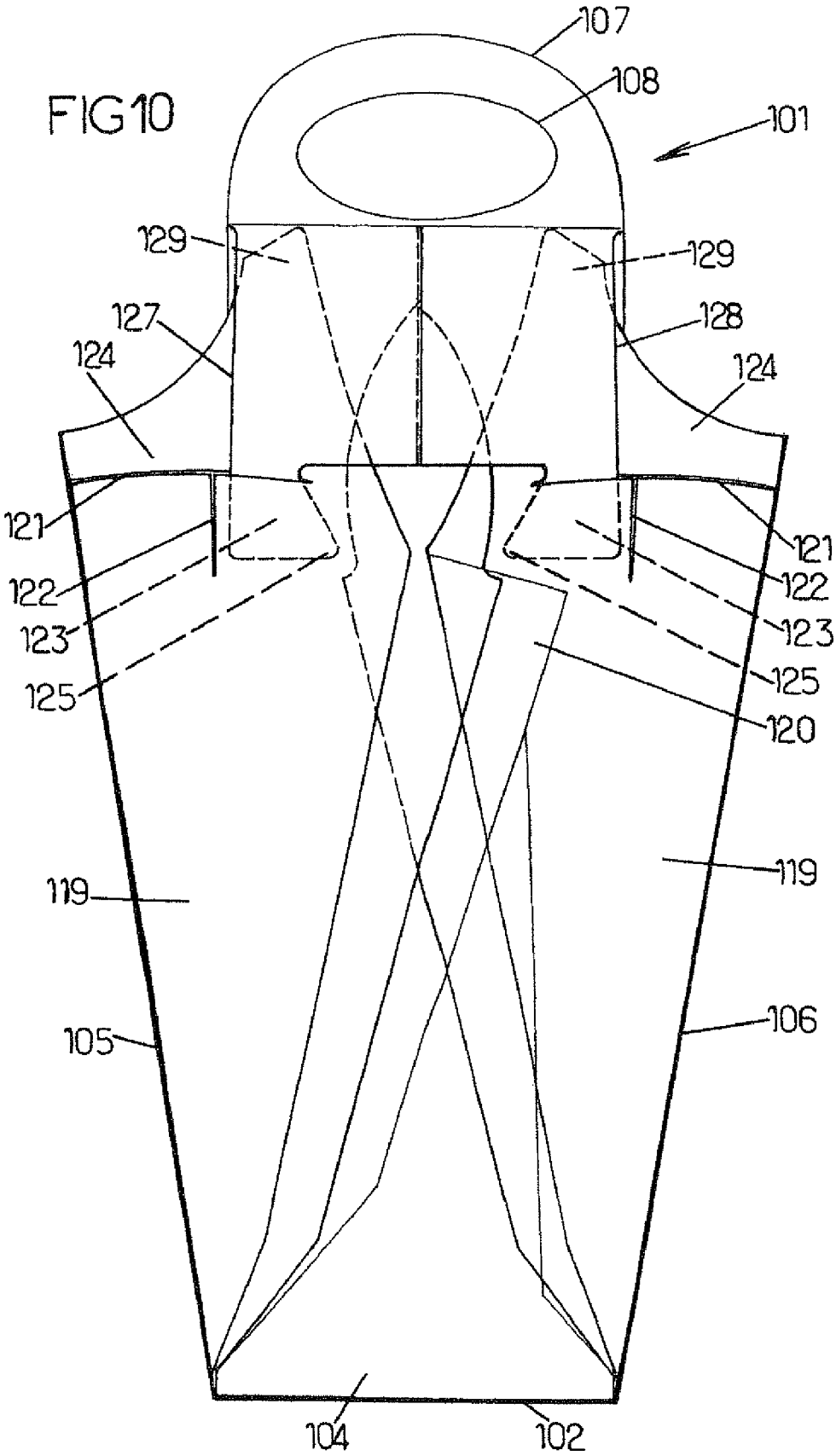

The third and fourth lateral walls 105, 106 are connected to the first and second lateral walls 103, 104 in such a way as to allow each of said third and fourth lateral walls 105, 106 to be moved between:

- the storage position shown in FIGS. 7 and 8, in which the upper extremities of the third and fourth lateral walls 105, 106 are relatively close to each other (in this position, the third and fourth lateral walls are approximately parallel to each other),
  - and the erected position shown in FIGS. 9 and 10, in which the upper extremities of said third and fourth lateral walls 105, 106 are further apart from each other, said third and fourth lateral walls thus forming between them an angle between 15 and 30°, for example.

The packaging 101 is designed to contain for example a bottle, particularly a bottle of Champagne, and it can be used as a Champagne bucket in the aforementioned erected position. In this erected position, ice and/or water can therefore be added inside the packaging 101 to cool down the bottle that it contains.

As can be seen in particular in FIGS. 7 and 9, the upper extremity of each of the first and second lateral walls 103, 104 can be defined at the top by a convex rounded upper edge 107 below which an opening 108 is arranged, which can be for example a horizontally elongated oval shape, in such a way as to form two handles in the upper part of the packaging 101, thus facilitating the transport of said packaging by a user.

Figure 11:
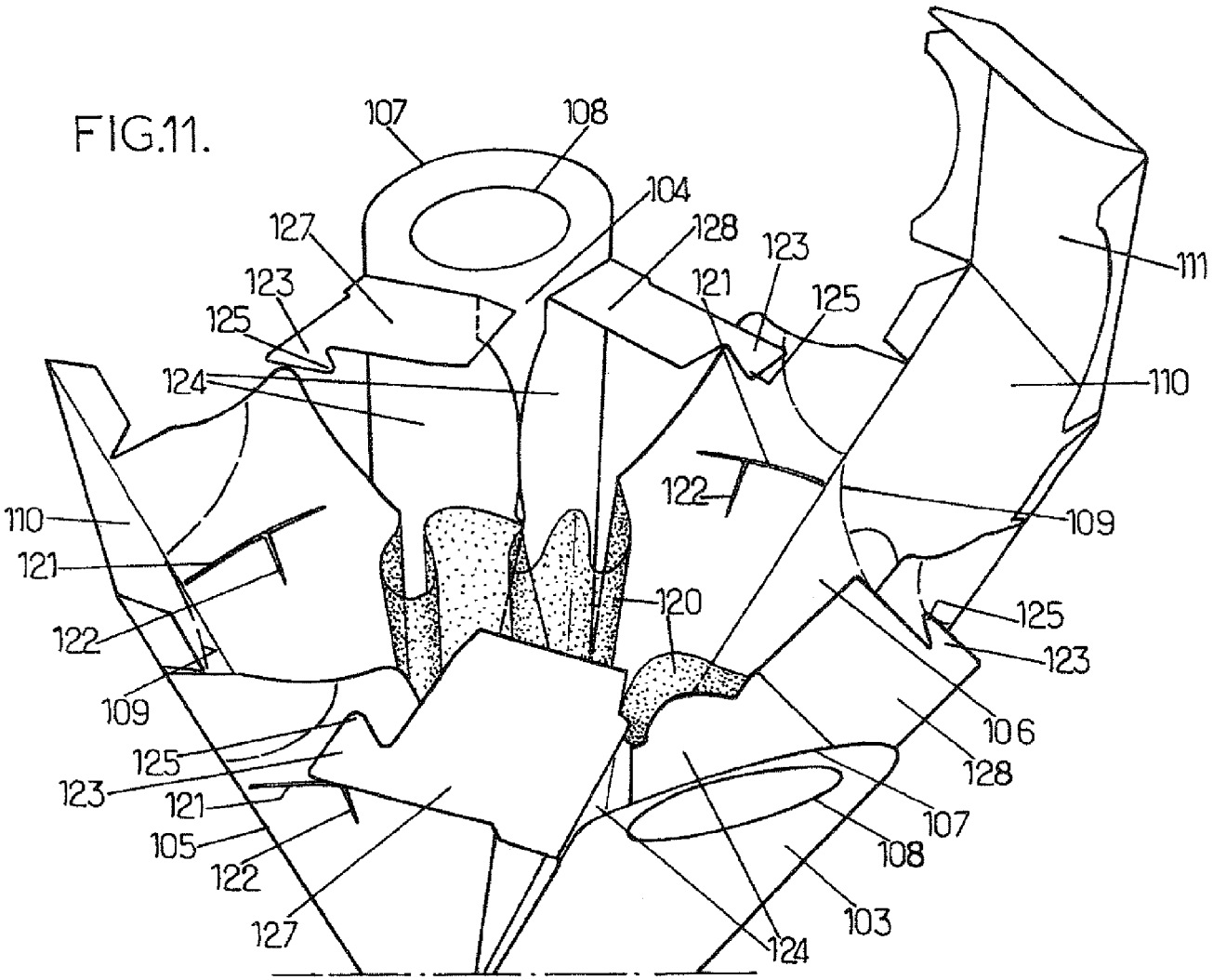
Figure 12:
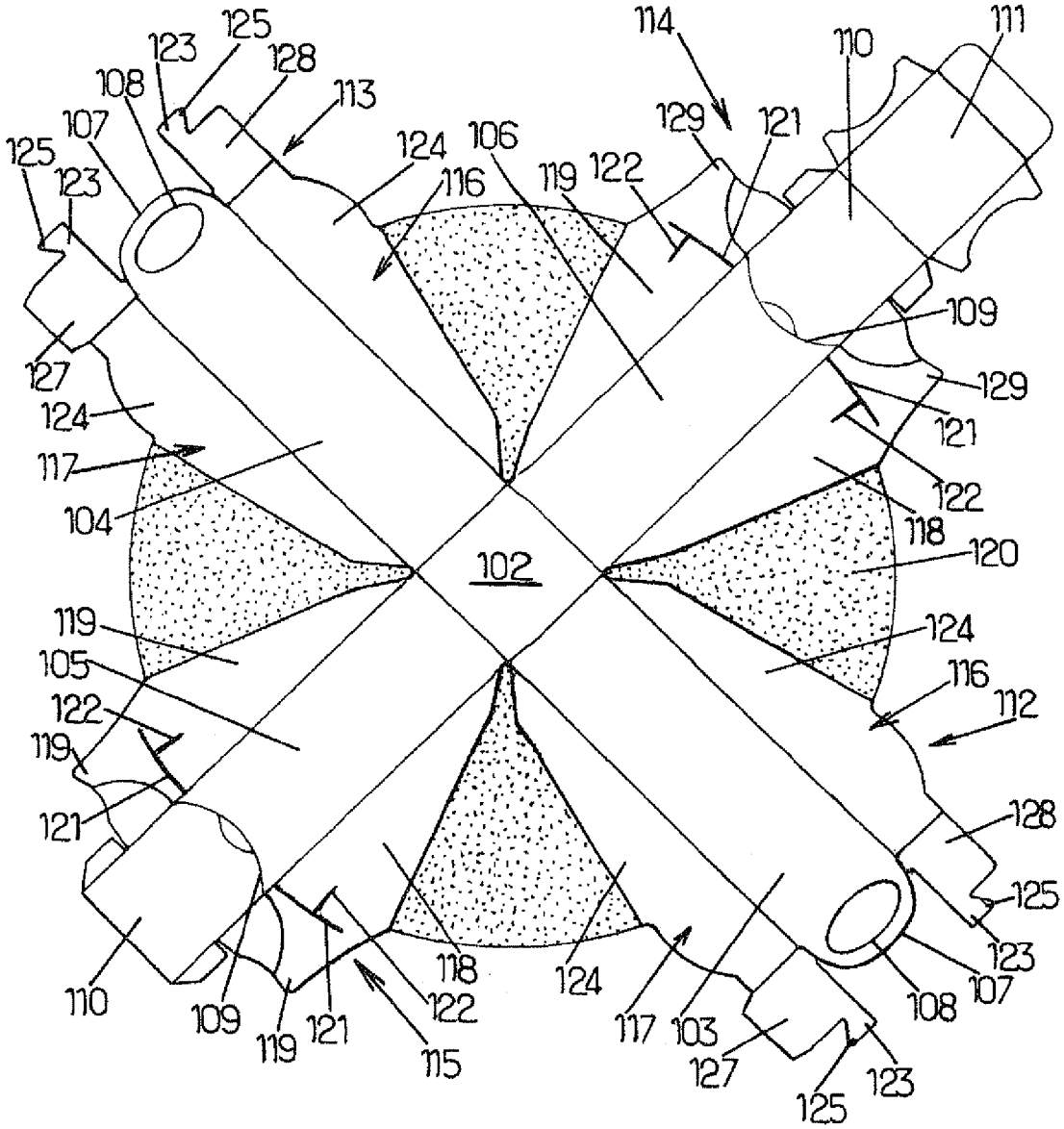

Furthermore, as can be seen in particular in FIGS. 7, 11 and 12, the third and fourth lateral walls 105, 106 can each have a pre-cut area 109 that allows for the upper extremity 110 of said third and fourth lateral walls to be detached. The upper extremity 110 of the fourth lateral wall 106 is also extended by an upper wall 111 that is glued to the upper extremity 110 of the third lateral wall. The upper extremities 110 of the third and fourth lateral walls 105, 106, together with the upper wall 111, form a detachable lid.

As shown in FIGS. 11 and 12, the blank made from cardboard, plastic or a similar material, is cruciform and comprises first, second, third and fourth arms 112, 113, 114 and 115 which include respectively the first, second, third and fourth lateral walls 103, 104, 105 and 106 and which each also include two articulated flaps, 116, 117 for the first and second lateral walls 103, 104 and 118, 119 for the third and fourth lateral walls 105, 106 respectively.

The flaps 116, 117, 118, 119 are respectively articulated along the lateral edges of the corresponding lateral walls and, when the packaging 101 is assembled, all of these flaps are arranged parallel to the first and second lateral walls 103, 104.

As will be explained below, the flaps 116, 117, 118, 119 respectively comprise slits and lugs that cooperate by fitting into each other to limit the displacement of the third and fourth lateral walls 105, 106 in the erected position.

Furthermore, as can be seen in FIG. 12, a flexible membrane 120, for example a thin film of polypropylene, is glued to the inner surface of the cardboard blank and forms a continuation between the various arms 112, 113, 114, 115 of the blank. Advantageously, two identical or similar flexible membranes 120 are glued respectively to the inner surface and the outer surface of the cardboard blank, and are glued to each other between the various arms 112-115 of the cardboard blank.

When the packaging 101 is assembled from the cardboard blank shown in FIG. 12, the portions of the membranes 120 that are located between the various arms 112-115 of the cardboard blank fold like bellows (see FIG. 11) and render the packaging 101 leak proof vis-à-vis the water or other liquid that can be poured into it.

In the example in FIGS. 7 to 12, the flaps 118, 119 on the third and fourth lateral walls 105, 106 each comprise an arc-shaped slit 121. The slits 121 in the flaps 118 located on the side of the first lateral wall 103 are centred on the lower edge of said first lateral wall 103, and the slits 121 in the flaps 119 located on the side of the second lateral wall 104 are centred on the lower edge of said second lateral wall 104.

Furthermore, the flaps 118, 119 each comprise a cut-out 122 that is not parallel to the corresponding slit 121 and opens into said cut-out. In the example under consideration, the cut-out 122 is in the form of a slit approximately perpendicular to the corresponding slit 121. These cut-outs 122 facilitate the insertion of the lugs 123 on the flaps 116, 117 into the slits 121, as will be explained below.

The flaps 116, 117 in question each comprise, in the example under consideration, a first section 124 articulated on one of the lateral edges of the corresponding lateral wall 103, 104, and a second section. Each first section 124 is also extended upwards, on its upper extremity, by a second section 127, 128 respectively, which is articulated on the upper edge of said first section 124.

The second sections 127, 128 are extended downwards respectively by the lugs 123, which are advantageously hook-shaped with the tips 125 on two lugs 123 on the same lateral wall facing in opposite directions to each other.

When the packaging 101 is erected, as shown in FIG. 11, the lateral walls 103-106 are folded toward each other, the flaps 118, 119 on the third and fourth lateral walls are folded at 90° relative to said third and fourth lateral walls 105, 106, and the first sections 124 on the flaps 116, 117 are folded at 180° against the inner surface of the first and second lateral walls 103, 104.

Said first sections 124 can advantageously at least partly overlap and be rigidly attached to each other for example by gluing, whilst also being rigidly attached, for example by gluing, to the inner surface of the first and second lateral walls 103, 104.

The first sections 124 could optionally only be attached by gluing to the inner surface of the first and second lateral walls 103, 104, or only be rigidly attached to each other and not to said inner surface of the first and second lateral walls 103, 104.

When the packaging 101 is erected, the second sections 27, 28 are folded at 180° downwards, covering the upper extremities 129 of the flaps 118, 119, and the aforementioned lugs 123 are also slid into the slits 121 in the flaps 118, 119 (see FIG. 11), then said lugs 123 are preferably rigidly attached, in particular by gluing, to the first sections 124. Advantageously, the second sections 127, 128 overlap at least partly and are rigidly attached to each other, for example by gluing.

The invention claimed is:

1. An erectable packaging, comprising:

a blank that forms at least one base and four lateral walls each extending between two lateral edges from a lower extremity secured to the base to a free upper extremity, said lateral walls comprising parallel, mutually opposite first and second lateral walls and parallel, mutually opposite third and fourth lateral walls, the third and fourth lateral walls being connected to the first and second lateral walls to enable each of said third and fourth walls to be moved between a storage position in which the upper extremities of said third and fourth lateral walls are relatively close to each other and an erected position in which the upper extremities of said third and fourth lateral walls are further away from each other, wherein the blank is cruciform and comprises first, second, third and fourth arms that respectively include the first, second, third and fourth lateral walls, each of said arms also including at least two flaps articulated on the corresponding lateral wall, wherein the flaps on the first, second, third and fourth lateral walls are all parallel to the first and second lateral walls, the flaps on the first and second lateral walls each comprise a lug and the flaps on each of the third and fourth walls each comprise a slit receiving one of said lugs to limit the displacement of the third and fourth lateral walls in the erected position, wherein the base and the lateral walls are connected to each other by at least a first flexible membrane enabling the packaging to contain a liquid in a leak proof manner, and wherein the flaps on the first and second lateral walls each comprise a first section articulated on one of the lateral edges of the corresponding lateral wall and a second section folded downwards and articulated on the upper edge of the first section, said second section being extended by one of said lugs that enters one of the slits in the flaps on the third and fourth lateral walls.

2. The packaging according to claim 1, wherein the lugs on the second sections of the first lateral wall extend downwards from the second sections and are rigidly attached to the first sections of said first lateral wall, and the lugs on the second sections of the second lateral wall extend downwards from the second sections and are rigidly attached to the first sections of said second lateral wall.

3. An erectable packaging, comprising:

a blank that forms at least one base and four lateral walls each extending between two lateral edges from a lower extremity secured to the base to a free upper extremity, said lateral walls comprising parallel, mutually opposite first and second lateral walls and parallel, mutually opposite third and fourth lateral walls, the third and fourth lateral walls being connected to the first and second lateral walls to enable each of said third and fourth walls to be moved between a storage position in which the upper extremities of said third and fourth lateral walls are relatively close to each other and an erected position in which the upper extremities of said third and fourth lateral walls are further away from each other, wherein the blank is cruciform and comprises first, second, third and fourth arms that respectively include the first, second, third and fourth lateral walls, each of said arms also including at least two flaps articulated on the corresponding lateral wall, wherein the flaps on the first, second, third and fourth lateral walls are all parallel to the first and second lateral walls, the flaps on the first and second lateral walls each comprise a lug and the flaps on each of the third and fourth walls each comprise a slit receiving one of said lugs to limit the displacement of the third and fourth lateral walls in the erected position, wherein the base and the lateral walls are connected to each other by at least a first flexible membrane enabling the packaging to contain a liquid in a leak proof manner, and wherein the flaps on the first and second lateral walls each comprise a first section articulated on one of the lateral edges of the corresponding lateral wall and a second section folded downwards and articulated on the upper edge of the first section, said first section comprising a cut-out lug that enters one of the slits in the flaps on the third and fourth lateral walls.

4. The packaging according to claim 3, wherein the lugs on the first sections of the first lateral wall extend upwards from said first sections and are rigidly attached to the second sections of said first lateral wall, and the lugs on the first sections of the second lateral wall extend upwards from said first sections and are rigidly attached to the second sections of said second lateral wall.

5. The packaging according to claim 1, wherein the first sections of the first lateral wall are rigidly attached to the inner surface of said first lateral wall, and the first sections of the second lateral wall are rigidly attached to the inner surface of said second lateral wall.

6. The packaging according to claim 1, wherein the first sections of the first lateral wall at least partly overlap and are rigidly attached to each other, and the first sections of the second lateral wall at least partly overlap and are rigidly attached to each other.

7. The packaging according to claim 1, wherein the second sections of the first lateral wall at least partly overlap and are rigidly attached to each other, and the second sections of the second lateral wall at least partly overlap and are rigidly attached to each other.

8. The packaging according to claim 1, wherein the second sections of the first and second lateral walls at least partly overlap the corresponding flaps on the third and fourth lateral walls.

* * * * *